US010851551B2

(12) United States Patent
Itagaki et al.

(10) Patent No.: US 10,851,551 B2
(45) **Date of Patent: *Dec. 1, 2020**

(54) BINDING MACHINE

(71) Applicant: MAX CO., LTD., Tokyo (JP)

(72) Inventors: Osamu Itagaki, Tokyo (JP); Akira Kasahara, Tokyo (JP); Norihiro Nagai, Tokyo (JP)

(73) Assignee: MAX CO., LTD., Tokyo (JP)

( * ) Notice: Subject to any disclaimer, the term of this patent is extended or adjusted under 35 U.S.C. 154(b) by 171 days.

This patent is subject to a terminal disclaimer.

(21) Appl. No.: 15/847,668

(22) Filed: Dec. 19, 2017

(65) Prior Publication Data

US 2018/0187434 A1 Jul. 5, 2018

(30) Foreign Application Priority Data

Dec. 29, 2016 (JP) ..... 2016-257450

(51) Int. Cl.
*E04G 21/12* (2006.01)
*B21F 15/04* (2006.01)
*B65B 13/02* (2006.01)

(52) U.S. Cl.
CPC ..... *E04G 21/123* (2013.01); *B21F 15/04* (2013.01); *B65B 13/025* (2013.01)

(58) Field of Classification Search
CPC .. B21F 9/02; B21F 15/00; B21F 15/02; B21F 15/04; B21F 23/00; B21F 23/005;
(Continued)

(56) References Cited

U.S. PATENT DOCUMENTS 4,790,225 A 12/1988 Moody et al.
5,842,506 A 12/1998 Peters
(Continued)

FOREIGN PATENT DOCUMENTS

CN 2652552 Y 11/2004
CN 1660675 A 8/2005
(Continued)

OTHER PUBLICATIONS

Office Action issued in U.S. Appl. No. 16/395,988, dated Jul. 5, 2019 (24 pages).
(Continued)

*Primary Examiner* — Pradeep C Battula
(74) *Attorney, Agent, or Firm* — Rothwell, Figg, Ernst & Manbeck, P.C.

(57) ABSTRACT

A binding machine includes a wire feeding unit configured to feed a wire, a curl guide configured to curl the wire fed by the wire feeding unit around an object to be bound, a binding unit including a twisting shaft provided to be rotatable around a predetermined axis, and a gripping part provided at one end side of the twisting shaft, wherein the gripping part is configured to grip the wire curled by the curl guide and the twisting shaft is configured to twist the gripped wire so as to bind the object, a binding machine main body having one end side at which the curl guide is arranged and configured to accommodate therein the wire feeding unit and the binding unit, and a setting unit provided at an opposite end side of the binding machine main body and configured to set a predetermined operation condition.

19 Claims, 10 Drawing Sheets

(58) Field of Classification Search
CPC ..... B21F 33/00; B65B 13/025; B65B 13/027; B65B 13/28; B65B 13/285; B65B 13/22; B65B 27/10; B65H 59/04; E04G 21/122; E04G 21/123
See application file for complete search history.

(56) References Cited

U.S. PATENT DOCUMENTS

| | | | |
|---|---|---|---|
| 8,127,803 | B2 | 3/2012 | Kusakari |
| 2005/0178460 | A1 | 8/2005 | Magno, Jr. |
| 2007/0199610 | A1 | 8/2007 | Itagaki |
| 2007/0227613 | A1 | 10/2007 | Matsuoka et al. |
| 2008/0006341 | A1 | 1/2008 | Kusakari et al. |
| 2008/0110354 | A1 | 5/2008 | Itagaki et al. |
| 2009/0090428 | A1 | 4/2009 | Kasahara et al. |
| 2015/0176295 | A1 | 6/2015 | Kasahara et al. |
| 2019/0249447 | A1* | 8/2019 | Itagaki ..... E04G 21/123 |

FOREIGN PATENT DOCUMENTS

| | | | |
|---|---|---|---|
| CN | 1969101 | A | 5/2007 |
| CN | 1985058 | A | 6/2007 |
| EP | 1 564 146 | A1 | 8/2005 |
| EP | 1 840 030 | A1 | 10/2007 |
| JP | H07-100770 | A | 4/1995 |
| JP | 2006-200196 | A | 8/2006 |
| JP | 2011-005555 | A | 1/2011 |
| TW | 200714519 | A | 4/2007 |
| WO | 2017/014276 | A1 | 1/2017 |

OTHER PUBLICATIONS

Extended European Search Report dated Feb. 12, 2018 in corresponding EP Patent Application No. 17208816.3 (7 pages).
European Search Report issued in Application No. 19194087.3, dated Jan. 9, 2020, 7 pages.
Office Action issued for corresponding Japanese Application No. 2016-257450 dated Sep. 29, 2020 (6 pages).

* cited by examiner

BINDING MACHINE

CROSS-REFERENCE TO RELATED APPLICATION

This application claims the priority from Japanese Patent Application No. 2016-257450 filed on Dec. 29, 2016, the entire contents of which are incorporated herein by reference.

FIELD

The present disclosure relates to a binding machine configured to bind an object to be bound such as a reinforcing bar with a wire.

BACKGROUND

In the related art, a binding machine called as a reinforcing bar binding machine configured to wind a wire around reinforcing bars, and to bind the reinforcing bars by twisting the wire wound on the reinforcing bars has been suggested.

The reinforcing bar binding machine includes a magazine configured to accommodate therein a wire reel on which a wire is wound, a wire feeding unit configured to feed the wire reeled out from the wire reel accommodated in the magazine, a curl guide unit configured to curl the wire fed by the wire feeding unit around an object to be bound (reinforcing bars), and a binding unit configured to bind the object to be bound by twisting the wire curled with the curl guide unit. The magazine is provided at an outer side of a binding machine main body, the wire feeding unit and the binding unit are provided in the binding machine main body, and the curl guide unit is provided so that a part thereof is exposed from one end of the binding machine main body. The binding machine main body is provided with a handle part extending in a predetermined direction, and a setting unit for setting a variety of operation conditions, such as an adjustment dial configured to adjust torsional torque of the wire, and an LED for notifying an operator of an operating state, and the like are arranged on a surface part (upper surface) opposite to the handle part with respect to the binding machine main body (for example, refer to JP-A-2006-200196).

According to the above binding machine, since the setting unit, the LED and the like are arranged on the upper surface of the binding machine main body, it is difficult to check (visually recognize) states of the setting unit, the LED and the like while an operator performs a binding operation with gripping the handle part. For this reason, the operator should change a position and an angle of the reinforcing bar binding machine so as to see the setting unit, the LED and the like or change a posture of an upper body of the operator so as to see the upper surface of the binding machine main body.

The present disclosure has been made in view of the above situations, and an object thereof is to provide a binding machine by which an operator can easily check a setting unit and the like while performing a binding operation.

In order to accomplish the above object, the present disclosure provides a binding machine including: a wire feeding unit configured to feed a wire; a curl guide configured to curl the wire fed by the wire feeding unit around an object to be bound; a binding unit including a twisting shaft provided to be rotatable around a predetermined axis, and a gripping part provided at one end side of the twisting shaft, wherein the gripping part is configured to grip the wire curled by the curl guide and the twisting shaft is configured to twist the gripped wire so as to bind the object; a binding machine main body having one end side at which the curl guide is arranged and configured to accommodate therein the wire feeding unit and the binding unit; and a setting unit provided at an opposite end side of the binding machine main body and configured to set a predetermined operation condition.

According to the present disclosure, since the setting unit is provided at the opposite end side, which is opposite to the curl guide unit, of the binding machine main body, the setting unit is arranged at a visually recognizable position at a state where the curl guide unit is made to face the object to be bound.

According to the present disclosure, since the setting unit is provided at the opposite end side, which is opposite to the curl guide unit, of the binding machine main body, the operator can easily check and operate the setting unit while performing the binding operation.

DETAILED DESCRIPTION

Hereinafter, an example of a reinforcing bar binding machine, which is an embodiment of the binding machine of the present disclosure, will be described with reference to the drawings.

<Example of Configuration of Reinforcing Bar Binding Machine of Embodiment>

Figure 1:
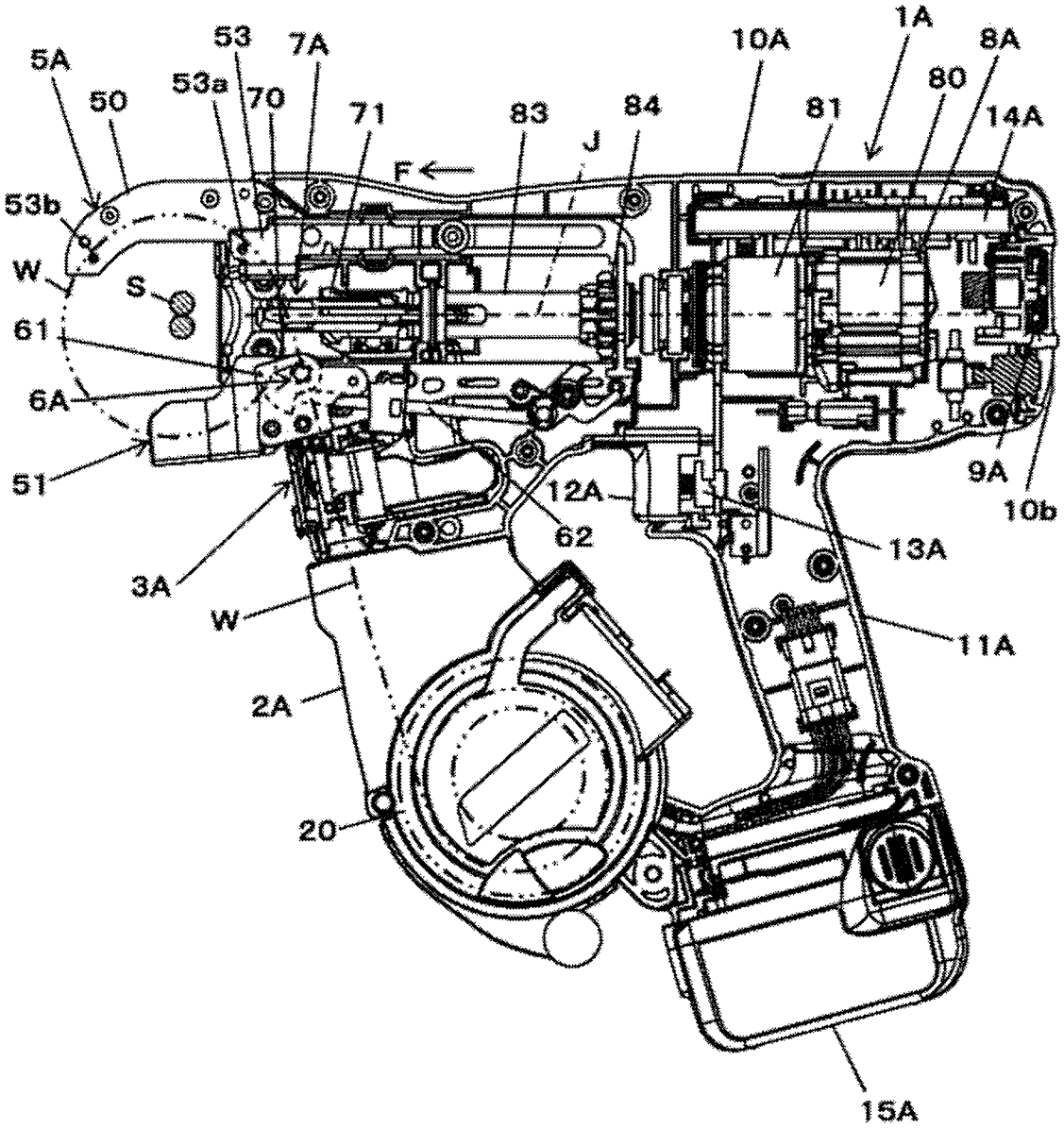
FIG. 1 is a view depicting an example of an entire configuration of a reinforcing bar binding machine of an embodiment, as seen from a side.
Figure 2:
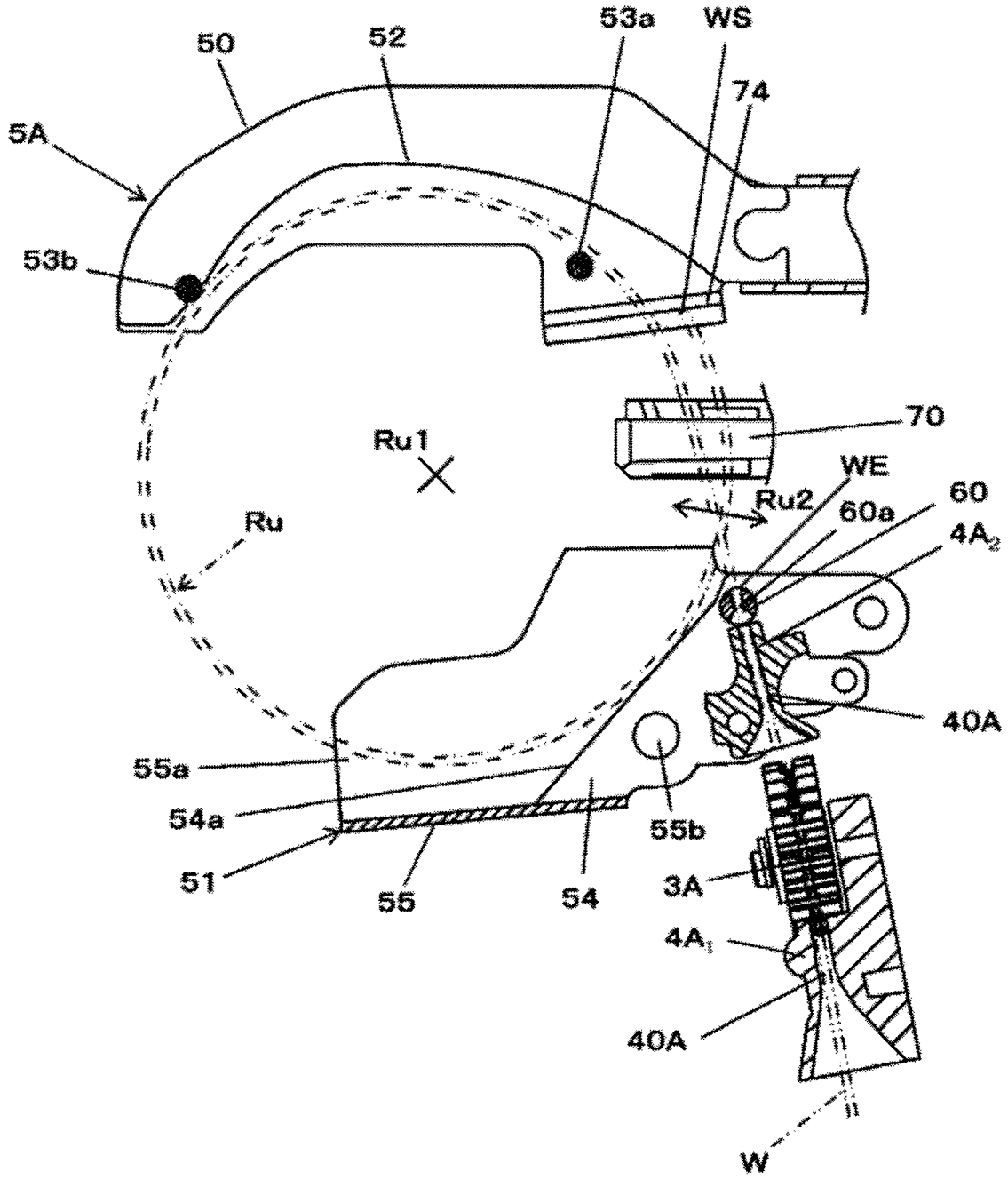
FIG. 2 is a view depicting an example of a main configuration of the reinforcing bar binding machine of the embodiment, as seen from a side.

FIG. 1 is a view depicting an example of an entire configuration of a reinforcing bar binding machine of an embodiment, as seen from a side, and FIG. 2 is a view depicting an example of a main configuration of the reinforcing bar binding machine of the embodiment, as seen from a side.

A reinforcing bar binding machine 1A of an embodiment includes a housing to be gripped by an operator's hand. The reinforcing bar binding machine 1A includes a main body part (binding machine main body) 10A and a handle part 11A extending from the main body part 10A. The reinforcing bar binding machine 1A is configured to feed a wire W in a forward direction, which is one direction, to wind (curl) the wire around reinforcing bars S, which are an example of the object to be bound, and then, to pull back the wire in a reverse direction to the forward direction and to wind the wire on the reinforcing bars S. The reinforcing bar binding machine 1A is configured to bind the reinforcing bars S with the wire W by gripping and twisting a part of the wire W wound on the reinforcing bars S.

The reinforcing bar binding machine 1A includes a magazine 2A, which is an accommodation unit configured to accommodate therein the wire W, a wire feeding unit 3A accommodated in the main body part 10A and configured to feed the wire W, a curl guide unit 5A arranged at one end side of the main body part 10A and configured to form a path along which the wire W fed by the wire feeding unit 3A is to be wound around the reinforcing bars S, a cutting unit 6A configured to cut the wire W wound around the reinforcing bars S, and a binding unit 7A accommodated in the main body part 10A and configured to bind the reinforcing bars S by twisting the wire W curled along the reinforcing bars S with the curl guide unit 5A. The reinforcing bar binding machine 1A includes a first wire guide 4$A_1$ provided upstream of the wire feeding unit 3A and configured to guide the wire W, which is to be fed into the wire feeding unit 3A, and a second wire guide 4$A_2$ provided downstream of the wire feeding unit 3A and configured to guide the wire W, which is to be delivered from the wire feeding unit 3A.

In the magazine 2A, a reel 20 on which the long wire W is wound to be reeled out is rotatably and detachably accommodated. In the reinforcing bar binding machine 1A of the embodiment, two wires W are wound to be reeled out on the reel 20 so that the reinforcing bars S can be bound with the two wires W. For the wire W, a wire made of a plastically deformable metal wire, a wire having a metal wire covered with a resin, a twisted wire or the like can be used. In the below, a side denoted with an arrow F at which the magazine 2A is provided is referred to as 'front' and a side at which the handle part 11A is provided is referred to as 'rear', with respect to a direction in which the magazine 2A and the handle part 11A are aligned side by side.

Figure 3:
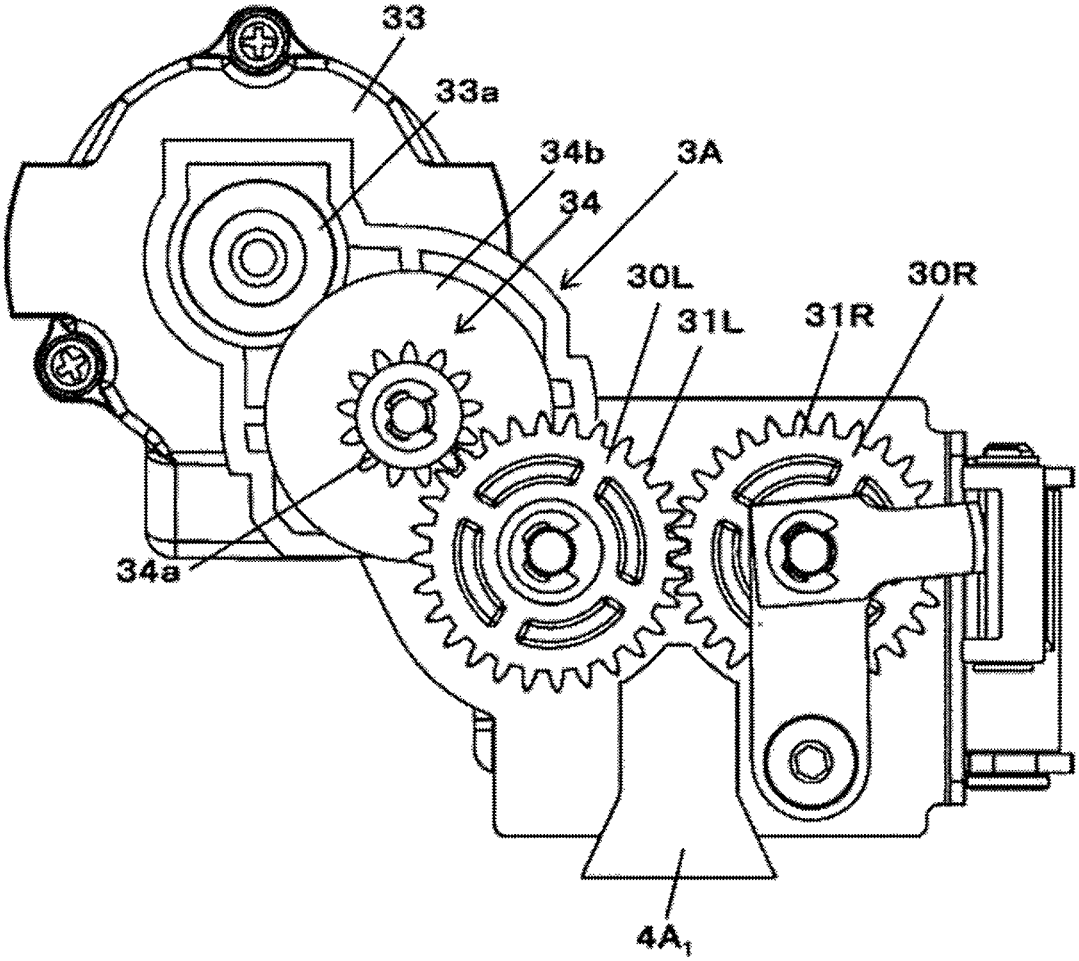
FIG. 3 is a view depicting an example of a wire feeding unit.
Figure 4:
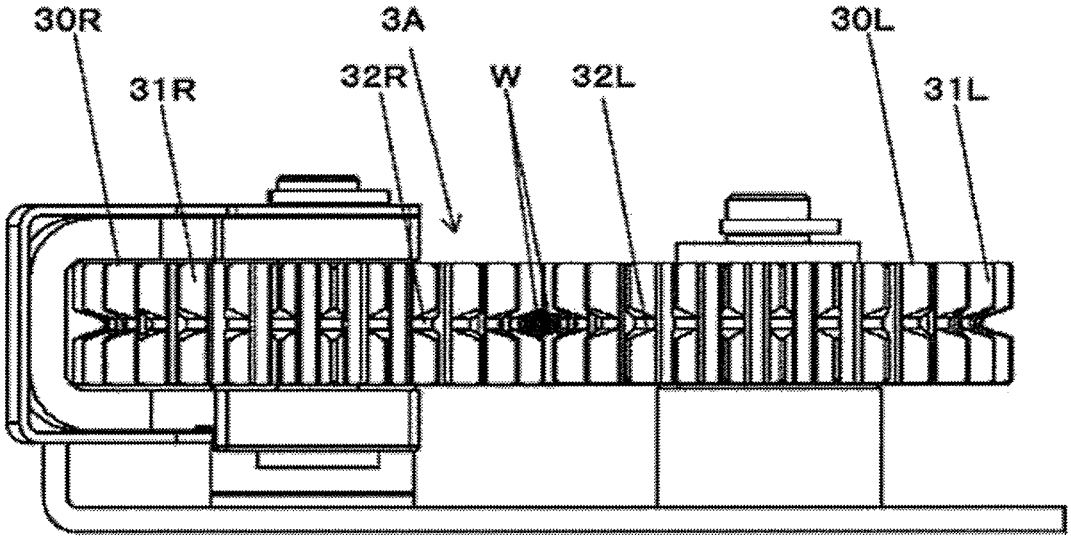
FIG. 4 is a view depicting the example of the wire feeding unit.

FIGS. 3 and 4 depict an example of the wire feeding unit. The wire feeding unit 3A includes a first feeding gear 30L and a second feeding gear 30R configured to feed the wire W by a rotating operation. The first feeding gear 30L and the second feeding gear 30R are a pair of feeding members configured to sandwich and feed two wires W aligned in parallel.

The first feeding gear 30L has a tooth part 31L configured to transmit a drive force. In this example, the tooth part 31L has a spur gear shape, and is formed on an entire circumference of an outer periphery of the first feeding gear 30L. Also, the first feeding gear 30L has a groove portion 32L into which the wire W enters. In this example, the groove portion 32L is a concave portion of which a sectional shape is a substantial V shape, and is formed on the entire circumference of the outer periphery of the first feeding gear 30L along a circumferential direction.

The second feeding gear 30R has a tooth part 31R configured to transmit a drive force. In this example, the tooth part 31R has a spur gear shape, and is formed on an entire circumference of an outer periphery of the second feeding gear 30R. Also, the second feeding gear 30R has a groove portion 32R into which the wire W enters. In this example, the groove portion 32R is a concave portion of which a sectional shape is a substantial V shape, and is formed on the entire circumference of the outer periphery of the second feeding gear 30R along a circumferential direction.

The first feeding gear 30L and the second feeding gear 30R are provided with the feeding path of the wire W being interposed therebetween so that the groove portion 32L and the groove portion 32R are arranged to face each other.

The first feeding gear 30L and the second feeding gear 30R are pressed as the first feeding gear 30L and the second feeding gear 30R come close to each other so as to sandwich the wire W therebetween. Thereby, the wire feeding unit 3A sandwiches the wire W between the groove portion 32L of the first feeding gear 30L and the groove portion 32R of the second feeding gear 30R.

Also, at a state where the wire W is sandwiched between the groove portion 32L of the first feeding gear 30L and the groove portion 32R of the second feeding gear 30R, the tooth part 31L of the first feeding gear 30L and the tooth part 31R of the second feeding gear 30R are meshed with each other.

The wire feeding unit 3A includes a feeding motor 33 configured to drive one of the first feeding gear 30L and the second feeding gear 30R, in this example, the first feeding gear 30L, and a drive force transmission mechanism 34 configured to transmit a drive force of the feeding motor 33 to the first feeding gear 30L.

The drive force transmission mechanism 34 includes a small gear 33*a* mounted to a shaft of the feeding motor 33 and a large gear 33*b* configured to mesh with the small gear 33*a*. Also, the drive force transmission mechanism 34 includes a feeding small gear 34*a*, which the drive force is transmitted thereto from the large gear 33*b* and is configured to mesh with the first feeding gear 30L. The small gear 33*a*, the large gear 33*b* and the feeding small gear 34*a* are respectively configured by a spur gear.

The first feeding gear 30L is configured to rotate as a rotating operation of the feeding motor 33 is transmitted thereto via the drive force transmission mechanism 34. The second feeding gear 30R is configured to rotate in conjunction with the first feeding gear 30L as a rotating operation of the first feeding gear 30L is transmitted thereto through engagement between the tooth part 31L and the tooth part 31R.

Thereby, the wire feeding unit 3A is configured to feed the wire W sandwiched between the first feeding gear 30L and the second feeding gear 30R along the extension direction of the wire W. In the configuration of feeding the two wires W, the two wires W are fed with being aligned in parallel by a frictional force that is to be generated between the groove portion 32L of the first feeding gear 30L and one wire W, a frictional force that is to be generated between the groove portion 32R of the second feeding gear 30R and the other wire W, and a frictional force that is to be generated between one wire W and the other wire W.

The wire feeding unit 3A is configured so that the rotation directions of the first feeding gear 30L and the second feeding gear 30R are switched and the feeding direction of the wire W is switched between the forward and reverse directions by switching the rotation direction of the feeding motor 33 between the forward and reverse directions.

Subsequently, the wire guide configured to guide the feeding of the wire W is described. As shown in FIG. 2, the first wire guide 4$A_1$ is arranged upstream of the first feeding gear 30L and the second feeding gear 30R with respect to the feeding direction of the wire W to be fed in the forward direction. Also, the second wire guide 4$A_2$ is arranged downstream of the first feeding gear 30L and the second feeding gear 30R with respect to the feeding direction of the wire W to be fed in the forward direction.

The first wire guide $4A_1$ and the second wire guide $4A_2$ have a guide hole 40A through which the wire W is to pass, respectively. The guide hole 40A has a shape for regulating a radial position of the wire W. In the configuration of feeding the two wires W, the first wire guide $4A_1$ and the second wire guide $4A_2$ are respectively formed with the guide hole 40A having a shape through which the two wires W are to pass with being aligned in parallel.

A wire introduction part, which is provided upstream of the guide hole 40A with respect to the feeding direction of the wire W to be fed in the forward direction, has a tapered shape of which an opening area is larger at an upstream side than a downstream side, such as a conical shape, a pyramid shape or the like. Thereby, the wire W can be easily introduced into the first wire guide $4A_1$ and the second wire guide $4A_2$.

Subsequently, the curl guide unit 5A configured to form the feeding path of the wire W along which the wire W is to be wound around the reinforcing bars S is described. The curl guide unit 5A includes a first guide (curl guide) 50 configured to curl the wire W, which is being fed by the first feeding gear 30L and the second feeding gear 30R, and a second guide (inductive guide) 51 configured to guide the wire W delivered from the first guide 50 toward the binding unit 7A.

The first guide 50 has a guide groove 52 configuring the feeding path of the wire W, and a first guide pin 53*a* and a second guide pin 53*b* serving as a guide member for curling the wire W in cooperation with the guide groove 52.

The first guide pin 53*a* is provided at an introduction part-side of the first guide 50, to which the wire W being fed by the first feeding gear 30L and the second feeding gear 30R is introduced, and is arranged at a radially inner side of a loop Ru to be formed by the wire W with respect to the feeding path of the wire W configured by the guide groove 52. The first guide pin 53*a* is configured to regulate the feeding path of the wire W so that the wire W being fed along the guide groove 52 do not enter the radially inner side of the loop Ru to be formed by the wire W.

The second guide pin 53*b* is provided at a discharge part-side of the first guide 50, from which the wire W being fed by the first feeding gear 30L and the second feeding gear 30R is discharged, and is arranged at a radially outer side of the loop Ru to be formed by the wires W with respect to the feeding path of the wire W configured by the guide groove 52.

The curl guide unit 5A includes a retraction mechanism 53 configured to retract the first guide pin 53*a*. The retraction mechanism 53 is configured to be displaced in conjunction with the operation of the binding unit 7A after the wire W is wound around the reinforcing bars S, and to retract the first guide pin 53*a* from a moving path of the wire W before the wire W is wound on the reinforcing bars S.

The second guide 51 has a third guide part 54 configured to regulate a radial position of the loop Ru, which is formed by the wire W to be wound around the reinforcing bars S, and a fourth guide part 55 configured to regulate a position along an axial direction Ru1 of the loop Ru, which is formed by the wire W to be wound around the reinforcing bars S.

The third guide part 54 has a wall surface 54*a* that is provided at a radially outer side of the loop Ru, which is formed by the wire W to be wound around the reinforcing bars S, and is configured by a surface extending along the feeding direction of the wire W. When the wire W is wound around the reinforcing bars S, the third guide part 54 regulates a radial position of the loop Ru, which is formed by the wire W to be wound around the reinforcing bars S, by the wall surface 54*a*.

The fourth guide part 55 is provided at an introduction-side of the wire W and has wall surfaces 55*a* that are provided at both sides in the axial direction Ru1 of the loop Ru, which is formed by the wire W to be wound around the reinforcing bars S, and are configured by surfaces erecting from the wall surface 54*a* toward the radially inner side of the loop Ru. When the wire W is wound around the reinforcing bars S, the fourth guide part 55 regulates a position along the axial direction Ru1 of the loop Ru, which is formed by the wire W to be wound around the reinforcing bars S, by the wall surfaces 55*a*.

Thereby, the wire W delivered from the first guide 50 is guided to the third guide part 54 by the fourth guide part 55 while a position of the axial direction Ru1 of the loop Ru to be formed around the reinforcing bars S is regulated by the wall surfaces 55*a* of the fourth guide part 55.

In this example, the second guide 51 is supported to the third guide part 54 at a state where the third guide part 54 is fixed to the main body part 10A of the reinforcing bar binding machine 1A and the fourth guide part 55 can rotate about a shaft 55*b*, which is a support point. The fourth guide part 55 is configured so that an introduction-side, to which the wire W delivered from the first guide 50 is to be introduced, can be opened and closed in directions of separating from and coming close to the first guide 50. Thereby, after binding the reinforcing bars S with the wire W, the fourth guide part 55 is retracted during an operation of pulling out the reinforcing bar binding machine 1A from the reinforcing bars S, so that it is possible to easily perform the operation of pulling out the reinforcing bar binding machine 1A from the reinforcing bars S.

Subsequently, the cutting unit 6A configured to cut the wire W wound around the reinforcing bars S is described. The cutting unit 6A includes a fixed blade part 60, a moveable blade part 61 configured to cut the wire W in cooperation with the fixed blade part 60, and a transmission mechanism 62 configured to transmit an operation of the binding unit 7A to the moveable blade part 61. The fixed blade part 60 has an opening 60*a* through which the wire W is to pass, and an edge portion provided at the opening 60*a* and capable of cutting the wire W.

The fixed blade part 60 is provided downstream of the second wire guide $4A_2$ with respect to the feeding direction of the wire W that is fed in the forward direction, and the opening 60*a* configures a third wire guide.

The wire W that is fed by the first feeding gear 30L and the second feeding gear 30R is curled as the radial position of the loop Ru to be formed by the wire W is regulated at least at three points of two points of the radially outer side of the loop Ru formed by the wire W and one point of the radially inner side between the two points.

In this example, a radially outer position of the loop Ru to be formed by the wire W is regulated at two points of the second wire guide $4A_2$ provided upstream of the first guide pin 53*a* and the second guide pin 53*b* provided downstream of the first guide pin 53*a* with respect to the feeding direction of the wire W that is fed in the forward direction. Also, a radially inner position of the loop Ru to be formed by the wire W is regulated by the first guide pin 53*a*.

The moveable blade part 61 is configured to cut the wire W, which is to pass through the opening 60*a* of the fixed blade part 60, by a rotating operation about the fixed blade part 60, which is a support point. The transmission mechanism 62 is configured to be displaced in conjunction with the operation of the binding unit 7A, and to rotate the moveable blade part 61 in conformity to timing at which the wire W is to be twisted after the wire W is wound on the reinforcing bars S, thereby cutting the wire W.

Figure 5A:
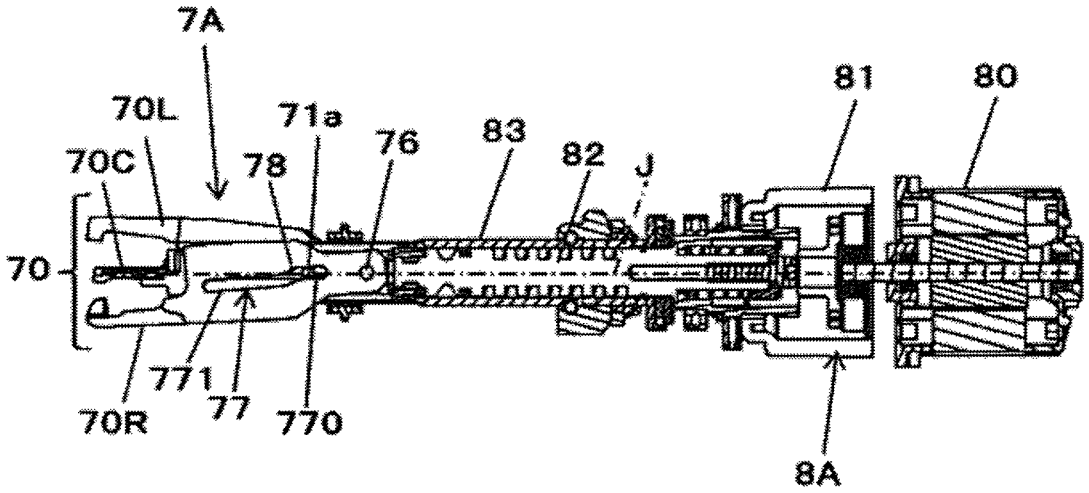
FIGS. 5A and 5B are views depicting an example of a binding unit.
Figure 5B:
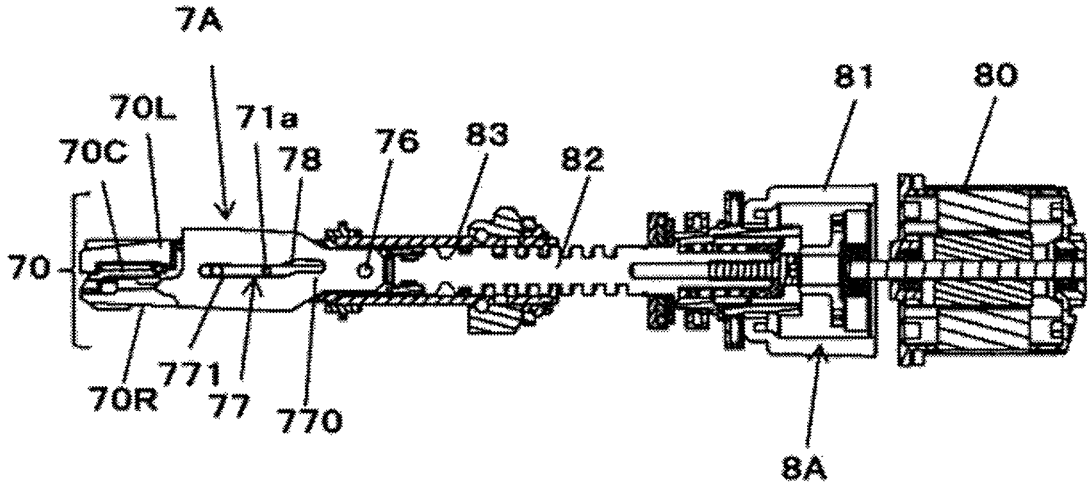
Figure 6:
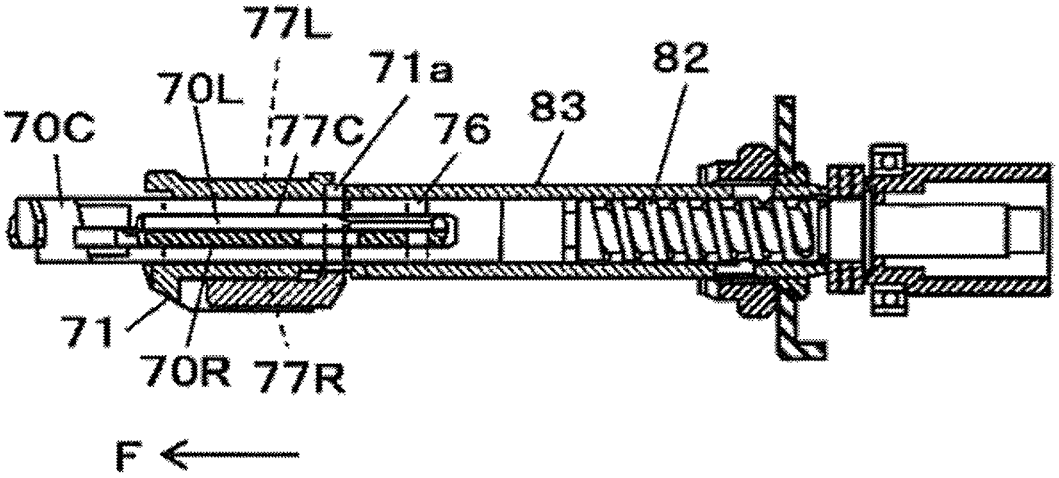
FIG. 6 is a view depicting the example of the binding unit.

FIGS. 5A, 5B and 6 depict an example of the binding unit. In the below, the binding unit 7A configured to bind the reinforcing bars S with the wire W is described.

The binding unit 7A includes a gripping part 70 configured to grip the wire W curled by the curl guide unit 5A, and a bending part 71 configured to bend one end portion WS and the other end portion WE of the wire W toward the reinforcing bars S.

The gripping part 70 includes a fixed gripping member 70C, a first moveable gripping member 70L, and a second moveable gripping member 70R. The first moveable gripping member 70L and the second moveable gripping member 70R are arranged at left and right sides with the fixed gripping member 70C being interposed therebetween. Specifically, the first moveable gripping member 70L is arranged at one side along the axial direction of the wire W to be wound and the second moveable gripping member 70R is arranged at the other side, with respect to the fixed gripping member 70C.

The first moveable gripping member 70L and the fixed gripping member 70C are configured so that the wire W is to pass between tip ends of the first moveable gripping member 70L and the fixed gripping member 70C. Also, the second moveable gripping member 70R and the fixed gripping member 70C are configured so that the wire W is to pass between tip ends of the second moveable gripping member 70R and the fixed gripping member 70C.

The fixed gripping member 70C has a shaft 76 configured to rotatably support the first moveable gripping member 70L and the second moveable gripping member 70R. The fixed gripping member 70C is configured to support rear ends of the first moveable gripping member 70L and the second moveable gripping member 70R with the shaft 76. Thereby, the first moveable gripping member 70L is opened and closed in directions in which the tip end thereof separates from and comes close to the fixed gripping member 70C by a rotating operation about the shaft 76, which is a support point. Also, the second moveable gripping member 70R is opened and closed in directions in which the tip end thereof separates from and comes close to the fixed gripping member 70C by a rotating operation about the shaft 76, which is a support point.

The bending part 71 has a shape covering a periphery of the gripping part 70 and is provided to be moveable along an axial direction of the binding unit 7A. The bending part 71 has an opening and closing pin 71*a* configured to open and close the first moveable gripping member 70L and the second moveable gripping member 70R. The first moveable gripping member 70L and the second moveable gripping member 70R have an opening and closing guide hole 77 configured to open and close the first moveable gripping member 70L and the second moveable gripping member 70R by an operation of the opening and closing pin 71*a*, respectively.

The opening and closing pin 71*a* passes through an inside of the bending part 71 and is perpendicular to a moving direction of the bending part 71. The opening and closing pin 71*a* is fixed to the bending part 71, and is configured to move in conjunction with movement of the bending part 71.

The opening and closing guide hole 77 extends in a moving direction of the opening and closing pin 71*a*, and has an opening and closing portion 78 configured to convert linear movement of the opening and closing pin 71*a* into an opening and closing operation resulting from the rotation of the second moveable gripping member 70R about the shaft 76, which is a support point. The opening and closing guide hole 77 has a first standby portion 770 extending in the moving direction of the bending part 71 by a first standby distance, and a second standby portion 771 extending in the moving direction of the bending part 71 by a second standby distance. The opening and closing portion 78 extends with being bent obliquely outward from one end portion of the first standby portion 770, and couples to the second standby portion 771. Meanwhile, in FIGS. 5A and 5B, the opening and closing guide hole 77 provided to the second moveable gripping member 70R is shown. However, the first moveable gripping member 70L is also provided with the opening and closing guide hole 77 having a bilaterally symmetric shape.

As shown in FIG. 5A, as the first moveable gripping member 70L and the second moveable gripping member 70R move in the directions of getting away from the fixed gripping member 70C, the gripping part 70 is formed with a feeding path through which the wire W is to pass between the first moveable gripping member 70L and the fixed gripping member 70C and between the second moveable gripping member 70R and the fixed gripping member 70C.

The wire W that is fed by the first feeding gear 30L and the second feeding gear 30R passes between the fixed gripping member 70C and the second moveable gripping member 70R and are guided to the curl guide unit 5A. The wire W curled by the curl guide unit 5A passes between the fixed gripping member 70C and the first moveable gripping member 70L.

When the bending part 71 is moved in a forward direction denoted with an arrow F in FIG. 6 and the opening and closing pin 71*a* thus pushes the opening and closing portion 78 of the opening and closing guide hole 77, the first moveable gripping member 70L and the second moveable gripping member 70R are moved in the directions of coming close to the fixed gripping member 70C by the rotating operation about the shaft 76, which is a support point.

As shown in FIG. 5B, the first moveable gripping member 70L is moved in the direction of coming close to the fixed gripping member 70C, so that the wire W is gripped between the first moveable gripping member 70L and the fixed gripping member 70C. Also, the second moveable gripping member 70R is moved in the direction of coming close to the fixed gripping member 70C, so that a gap in which the wire W is fed in the extension direction is formed between the second moveable gripping member 70R and the fixed gripping member 70C.

The bending part 71 has a bending portion 71*b*1 configured to push one end portion WS of the wire W gripped between the first moveable gripping member 70L and the fixed gripping member 70C. Also, the bending part 71 has a bending portion 71*b*2 configured to push the other end portion WE of the wire W gripped between the second moveable gripping member 70R and the fixed gripping member 70C.

The bending part 71 is moved in the forward direction denoted with the arrow F, so that one end portion WS of the wire W gripped by the fixed gripping member 70C and the first moveable gripping member 70L are pushed by the bending portion 71*b*1 and are thus bent toward the reinforcing bars S. Also, the bending part 71 is moved in the forward direction denoted with the arrow F, so that the other end portion WE of the wire W having passed between the fixed gripping member 70C and the second moveable gripping member 70R is pushed by the bending portion 71*b*1 and are thus bent toward the reinforcing bars S.

As shown in FIG. 2, the binding unit 7A includes a length regulation part 74 configured to regulate positions of one end portion WS of the wire W. The length regulation part 74 includes a member, to which one end portion WS of the wire W is to be butted, on the feeding path of the wire W having passed between the fixed gripping member 70C and the first moveable gripping member 70L.

Also, the binding unit 7A includes a rotary shaft (twisting shaft) 82 configured to twist the wire W gripped with the gripping part 70, a moveable member 83 configured to be displaced by a rotating operation of the rotary shaft 82, and a rotation regulation member 84 configured to regulate rotation of the moveable member 83 coupled to the rotating operation of the rotary shaft 82. Also, the reinforcing bar binding machine 1A includes a drive unit 8A configured to drive the binding unit 7A. The drive unit 8A includes a motor 80, and a decelerator 81 for deceleration and torsional torque amplification. The rotary shaft 82 is driven and rotated by the motor 80.

As shown in FIG. 5A, the rotary shaft 82 is provided to be rotatable around a predetermined axis J. The rotary shaft 82 and the moveable member 83 are configured so that the rotating operation of the rotary shaft 82 is converted into movement in a front and back direction along the rotary shaft 82 of the moveable member 83 by a screw part provided to the rotary shaft 82 and a nut part provided to the moveable member 83 and to be screwed to the screw part. The bending part 71 is provided integrally with the moveable member 83, so that the drive unit 8A moves the bending part 71 in the front and back direction by the movement of the moveable member 83 in the front and back direction.

The gripping part 70 is provided at a side (one end-side) of the rotary shaft 82, at which the curl guide unit 5A is provided. In an operation area in which the wire W is gripped by the gripping part 70 and the wire W is bent by the bending part 71, the moveable member 83, the bending part 71, and the gripping part 70 supported to the bending part 71 are engaged with the rotation regulation member 84, and are thus moved in the front and back direction with the rotating operation being regulated by the rotation regulation member 84. Also, when the moveable member 83, the bending part 71 and the gripping part 70 are disengaged from the rotation regulation member 84, they are rotated by the rotating operation of the rotary shaft 82.

The gripping part 70 is configured so that the fixed gripping member 70C, the first moveable gripping member 70L and the second moveable gripping member 70R gripping the wire W is rotated in conjunction with the rotation of the moveable member 83 and the bending part 71.

The retraction mechanism 53 of the first guide pin 53*a* is configured by a link mechanism configured to convert the movement of the moveable member 83 in the front and back direction into the displacement of the first guide pin 53*a*. Also, the transmission mechanism 62 of the moveable blade part 61 is configured by a link mechanism configured to convert the movement of the moveable member 83 in the front and back direction into the rotating operation of the moveable blade part 61.

Figure 7:
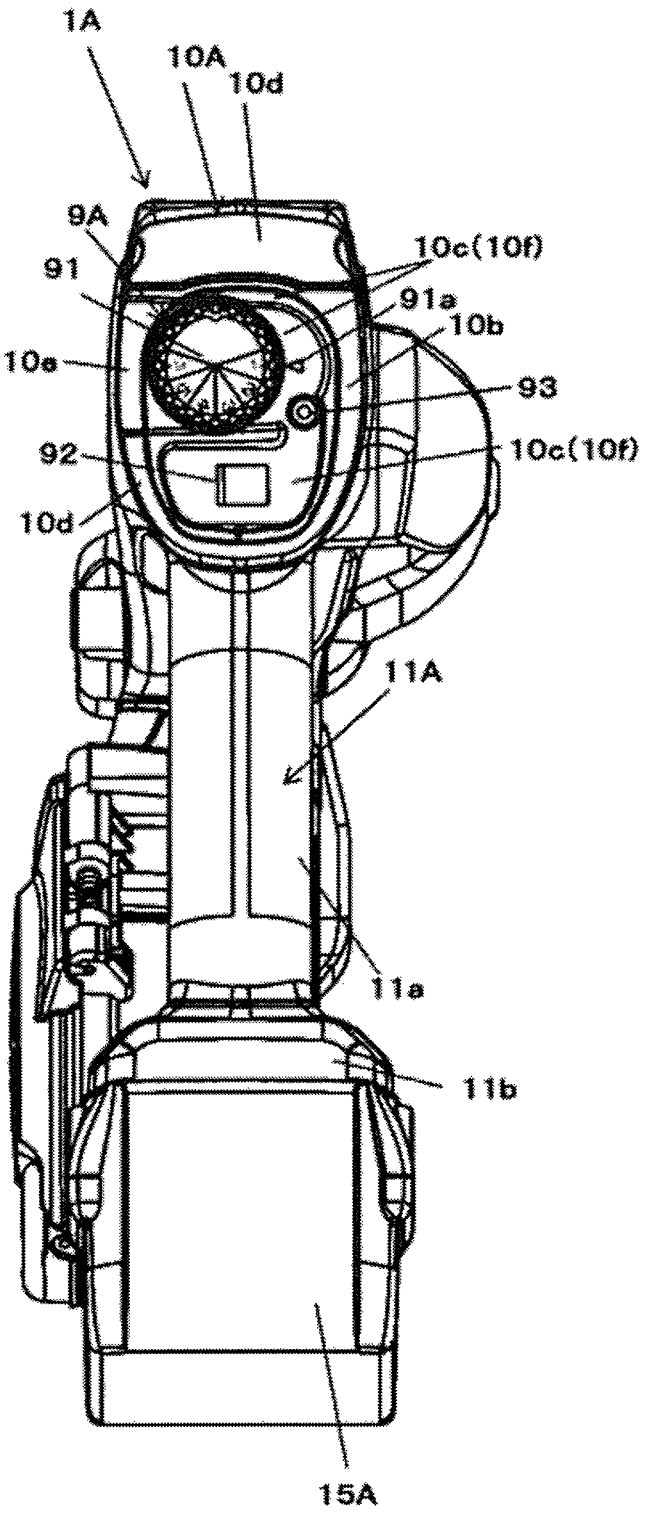
FIG. 7 is a view depicting the example of the entire configuration of the reinforcing bar binding machine of the embodiment, as seen from rear.
Figure 8:
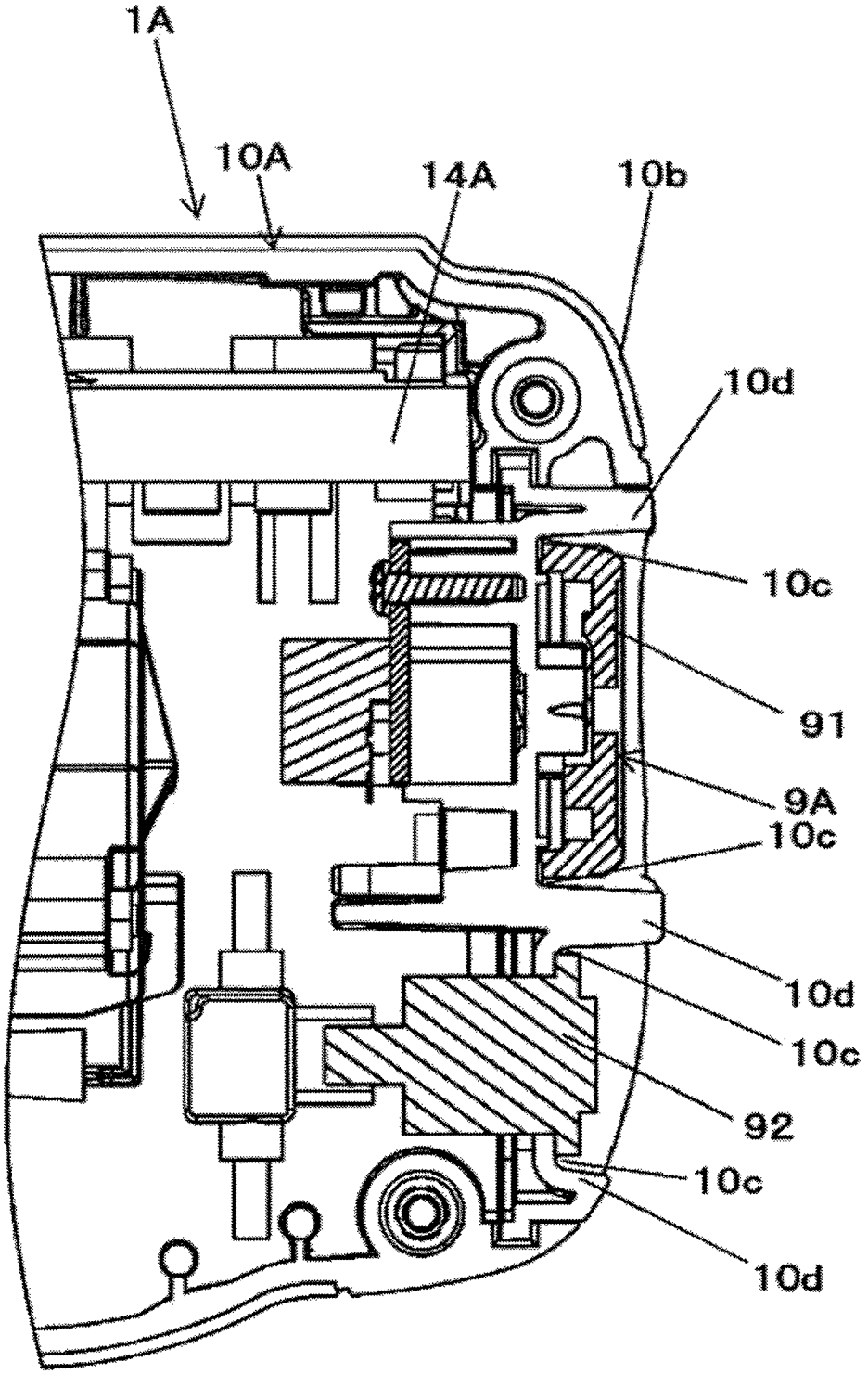
FIG. 8 is a view depicting the example of the main configuration of the reinforcing bar binding machine of the embodiment, as seen from a side.
Figure 9:
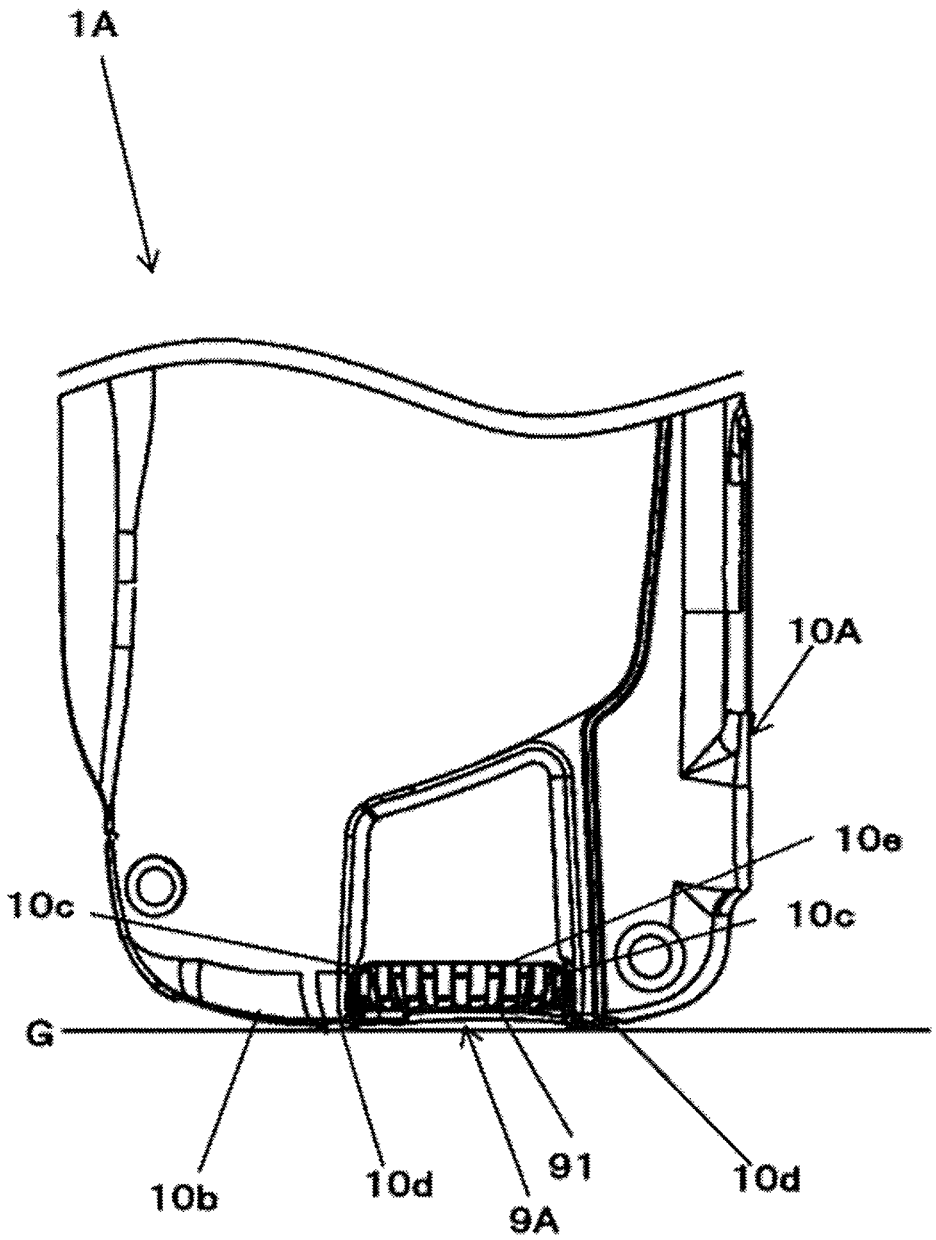
FIG. 9 is a view depicting the example of the main configuration of the reinforcing bar binding machine of the embodiment, as seen from a side.

FIG. 7 is a view depicting the example of the entire configuration of the reinforcing bar binding machine of the embodiment, as seen from rear, and FIGS. 8 and 9 are views depicting the example of the main configuration of the reinforcing bar binding machine of the embodiment, as seen from a side. In the below, a setting unit of the reinforcing bar binding machine 1A is described.

The handle part 11A extends from the main body part 10A in a direction perpendicular to or substantially perpendicular to the axis J (refer to FIGS. 1 and 5) coupling one end side of the main body part 10A, at which the curl guide unit 5A is provided, and an opposite end side. The handle part 11A includes a handle gripping part 11*a* that is to be gripped by an operator, and a battery mounting part lib at a lower part to which a battery 15A is detachably mounted. The handle part 11A is provided at a front side with a trigger 12A. In correspondence to a state of a switch 13A that is pressed when the trigger 12A is operated, a control unit 14A controls the feeding motor 33 and the motor 80. It is noted that the handle part 11A may extend in a direction which is not perpendicular to the axis J as long as the handle part 11A extends in a direction intersecting with the axis J.

A surface of the opposite end side, which is opposite to the curl guide unit 5A, of the main body part 10A, i.e., a rear surface 10*b* of the main body part 10A is provided with a concave part 10*c* and a convex part 10*d*. In the concave part 10*c*, an adjustment dial 91, a power supply switch 92, and a lamp 93 (information notification unit) are provided as a setting unit 9A for setting a predetermined operation condition of the reinforcing bar binding machine 1A. The convex part 10*d* is formed to surround the concave part 10*c* and the setting unit 9A.

As shown in FIG. 9, the setting unit 9A and the convex part 10*d* protrude with respect to the concave part 10*c*. The convex part 10*d* protrudes more backward than the setting unit 9A so that the setting unit 9A is not contacted to an operation place G when the reinforcing bar binding machine 1A is put on the operation place G by locating the surface 10*b* to a bottom.

The convex part 10*d* is provided at a side with a notch 10*e* configured to communicate with the surface 10*b* of the main body part 10A. As shown in FIG. 7, the concave part 10*c* is configured to form a series of paths 10*f* coupling to the notch 10*e* by using the convex part 10*d* and the setting unit 9A as sidewalls.

The adjustment dial 91 is connected to the motor 80 via the control unit 14A, so that when the adjustment dial 91 is turned, the control unit 14A changes a rotation speed of the motor 80. The adjustment dial 91 can adjust the rotation speed of the motor 80 in multiple steps. In the embodiment, for example, the adjustment dial 91 is described thereon with numbers of 1 to 6. When the adjustment dial 91 is turned so as to match the number to an indicator 91*a*, the rotation speed can be adjusted in six steps. When the rotation speed of the motor 80 is changed, the torsional torque of the wires W to be applied by the binding unit 7A is adjusted.

The power supply switch 92 is connected to the control unit 14A. At an off state, the power supply switch 92 stops an operation of the reinforcing bar binding machine 1A, and at an off state, the power supply switch 92 activates the reinforcing bar binding machine 1A to be in a standby state.

The lamp 93 is a notification unit configured to notify information, and is configured to emit light so as to notify whether the power supply switch 92 of the reinforcing bar binding machine 1A is at an on state or an off state. When the power supply switch 92 is at an on state, the lamp 93 is turned on, and when the supply switch 92 is at an off state, the lamp 93 is turned off.

The lamp 93 may be connected to the control unit 14A, and may blink so as to notify an occurrence of abnormality when the driving of the reinforcing bar binding machine 1A is abnormal. The reinforcing bar binding machine 1A is preferably provided with sensors configured to detect an abnormality of at least one of the rotation of the feeding motor 33, the rotation of the motor 80 and the rotation of the reel 20. When the respective sensors provided to the reinforcing bar binding machine 1A detect that the driving of the reinforcing bar binding machine 1A is abnormal, the sensor may transmit an abnormality signal to the control unit 14A, so that the control unit 14A causes the lamp 93 to blink for notifying the occurrence of abnormality.

<Example of Operation of Reinforcing Bar Binding Machine of Embodiment>

FIGS. 10A to 10D illustrate an example of an operation of gripping and twisting the wire in detail. In the below, an operation of binding the reinforcing bars S with the wire W by the reinforcing bar binding machine 1A of the embodiment is described with reference to each drawing.

When the operator pushes the power supply switch 92 to be at an on state, the reinforcing bar binding machine 1A is activated and is in an standby state. The lamp 93 is turned on. The operator turns the adjustment dial 91 to set the torsional torque for twisting the wire W, as necessary. The reinforcing bar binding machine 1A is in a standby state where the wire W is sandwiched between the first feeding gear 30L and the second feeding gear 30R, and the tip end of the wire W is positioned from the sandwiching position between the first feeding gear 30L and the second feeding gear 30R to the fixed blade part 60 of the cutting unit 6A. Also, as shown in FIG. 5A, when the reinforcing bar binding machine 1A is in the standby state, the first moveable gripping member 70L opens with respect to the fixed gripping member 70C and the second moveable gripping member 70R opens with respect to the fixed gripping member 70C.

When the reinforcing bars S are inserted between the first guide 50 and the second guide 51 of the curl guide unit 5A and the trigger 12A is operated, the feeding motor 33 is driven in the forward rotation direction, so that the first feeding gear 30L is rotated in the forward direction and the second feeding gear 30R is also rotated in the forward direction in conjunction with the first feeding gear 30L. Thereby, the two wires W sandwiched between the first feeding gear 30L and the second feeding gear 30R are fed in the forward direction.

The first wire guide $\mathbf{4}A_1$ is provided upstream of the wire feeding unit 3A and the second wire guide $\mathbf{4}A_2$ is provided downstream of the wire feeding unit 3A with respect to the feeding direction of the wire W to be fed in the forward direction, so that the two wires W are fed with being aligned in parallel.

When the wire W is fed in the forward direction, the wire W passes between the fixed gripping member 70C and the second moveable gripping member 70R and passes through the guide groove 52 of the first guide 50 of the curl guide unit 5A. Thereby, the wire W is curled to be wound around the reinforcing bars S at three points of the second wire guide $\mathbf{4}A_2$ and the first guide pin 53*a* and the second guide pin 53*b* of the first guide 50.

Figure 10A:
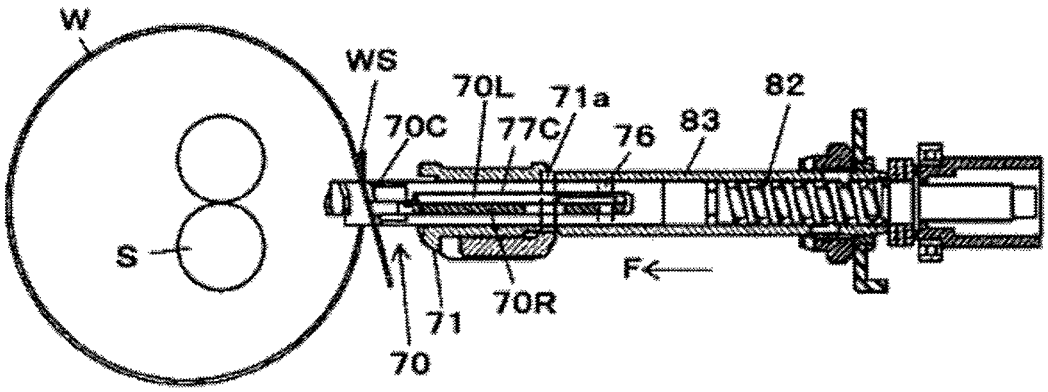
FIGS. 10A to 10D views illustrating an example of an operation of gripping and twisting wires.

The wire W delivered from the first guide 50 is guided between the fixed gripping member 70C and the first moveable gripping member 70L by the second guide 51. Then, when the tip end of the wire W is fed to a position at which the tip end is butted to the length regulation part 74, the driving of the feeding motor 33 is stopped. Thereby, as shown in FIG. 10A, the wire W is wound in a loop shape around the reinforcing bars S.

After stopping the feeding of the wire W, the motor 80 is driven in the forward rotation direction, so that the motor 80 moves the moveable member 83 in the arrow F direction, which is a forward direction. That is, a rotating operation of the moveable member 83 coupled to the rotation of the motor 80 is regulated by the rotation regulation member 84, so that the rotation of the motor 80 is converted into the linear movement. Thereby, the moveable member 83 is moved forward.

In conjunction with the forward movement of the moveable member 83, the bending part 71 is moved forward integrally with the moveable member 83, without being rotated. When the bending part 71 is moved forward, the opening and closing pin 71*a* passes through the opening and closing portion 78 of the opening and closing guide hole 77, as shown in FIG. 5B.

Thereby, the first moveable gripping member 70L is moved in the direction of coming close to the fixed gripping member 70C through the rotating operation about the shaft 76, which is a support point. Therefore, one end portion WS of the wire W is gripped between the first moveable gripping member 70L and the fixed gripping member 70C. Also, the second moveable gripping member 70R is moved in the direction of coming close to the fixed gripping member 70C through the rotating operation about the shaft 76, which is a support point. Therefore, the other end portion WE of the wire W is gripped to be moveable in the extension direction of the wires S between the second moveable gripping member 70R and the fixed gripping member 70C.

Also, when the moveable member 83 is moved forward, the operation of the moveable member 83 is transmitted to the retraction mechanism 53, so that the first guide pin 53*a* is retracted.

After advancing the moveable member 83 to a position at which the wire W is gripped through the opening and closing operation of the first moveable gripping member 70L and the second moveable gripping member 70R, the rotation of the motor 80 is temporarily stopped and the feeding motor 33 is driven in the reverse rotation direction. Thereby, the first feeding gear 30L is reversed, and the second feeding gear 30R is also reversed in conjunction with the first feeding gear 30L.

Figure 10B:
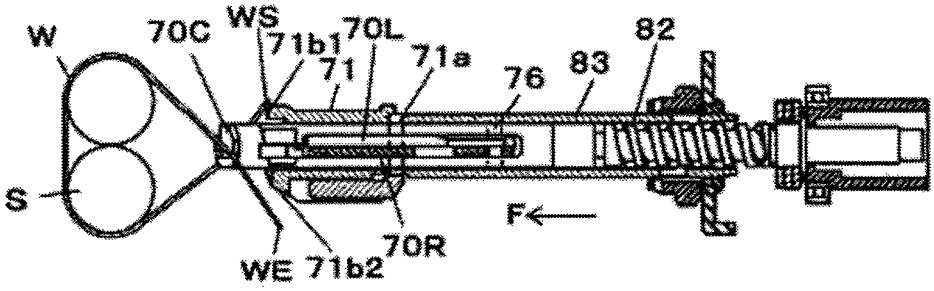

Therefore, the wire W sandwiched between the first feeding gear 30L and the second feeding gear 30R are fed in the reverse direction. During the operation of feeding the wire W in the reverse direction, the wire W is wound on the reinforcing bars S with being closely contacted thereto, as shown in FIG. 10B.

After winding the wire W on the reinforcing bars S and stopping the driving of the feeding motor 33 in the reverse rotation direction, the motor 80 is driven in the forward rotation direction, so that the moveable member 83 is moved forward. The forward moving operation of the moveable member 83 is transmitted to the cutting unit 6A by the transmission mechanism 62, so that the moveable blade part 61 is rotated and the other end portion WE of the wires W gripped with the second moveable gripping member 70R and the fixed gripping member 70C are cut by the operation of the fixed blade part 60 and the moveable blade part 61.

When binding the reinforcing bars S with the two wires W, like this example, it is possible to secure the strength equivalent to the case where the reinforcing bars S are bounded with one wire even when making a diameter of the respective wire W thinner. For this reason, it is possible to easily bend the wire W and to bring the wire W into close contact with the reinforcing bars S with the lower force. Therefore, it is possible to wind the wire W on the reinforcing bars S with the lower force. Also, it is possible to reduce the load when cutting the wires W. Accompanied by this, it is possible to miniaturize each motor and the mechanism part of the reinforcing bar binding machine 1A, thereby miniaturizing the entire main body part. Also, the motor is miniaturized and the load is reduced, so that it is possible to reduce the power consumption.

Figure 10C:
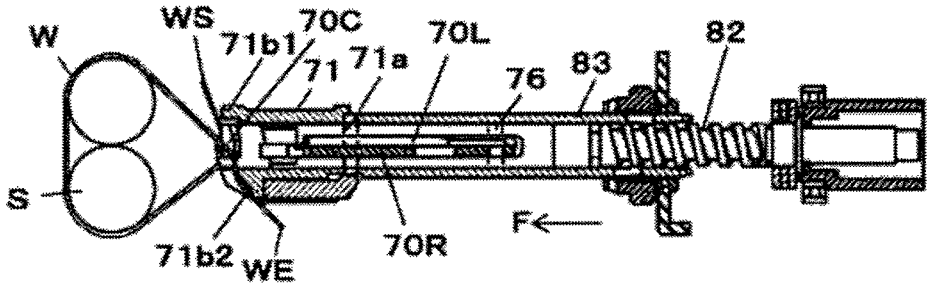

After cutting the wire W, the moveable member 83 is further moved forward, so that the bending part 71 is moved forward integrally with the moveable member 83, as shown in FIG. 10C. The bending part 71 is moved in the direction of coming close to the reinforcing bars S, which is the forward direction denoted with the arrow F, so that one end portion WS of the wire W gripped with the fixed gripping member 70C and the first moveable gripping member 70L is pressed toward the reinforcing bars S by the bending portion 71*b*1, and is thus bent toward the reinforcing bars S at the gripping position, which is a support point. The bending part 71 is further moved forward, so that one end portion WS of the wire W is held with being gripped between the first moveable gripping member 70L and the fixed gripping member 70C.

Also, the bending part 71 is moved in the direction of coming close to the reinforcing bars S, which is the forward direction denoted with the arrow F, so that the other end portion WE of the wire W gripped with the fixed gripping member 70C and the second moveable gripping member 70R is pressed toward the reinforcing bars S by the bending portion 71*b*2, and is thus bent toward the reinforcing bars S at the gripping position, which is a support point. The bending part 71 is further moved forward, so that the other end portion WE of the wire W is held with being gripped between the second moveable gripping member 70R and the fixed gripping member 70C.

After bending the end portions of the wire W toward the reinforcing bars S, the motor 80 is further driven in the forward rotation direction with a number of revolutions corresponding to the torsional torque of the wire W set with the adjustment dial 91. Thereby, the motor 80 further moves the moveable member 83 in the forward direction denoted with the arrow F. The moveable member 83 is moved to a predetermined position in the arrow F direction, so that the moveable member 83 is disengaged from the rotation regulation member 84 and the rotation regulation state of the moveable member 83 by the rotation regulation member 84 is released.

Figure 10D:
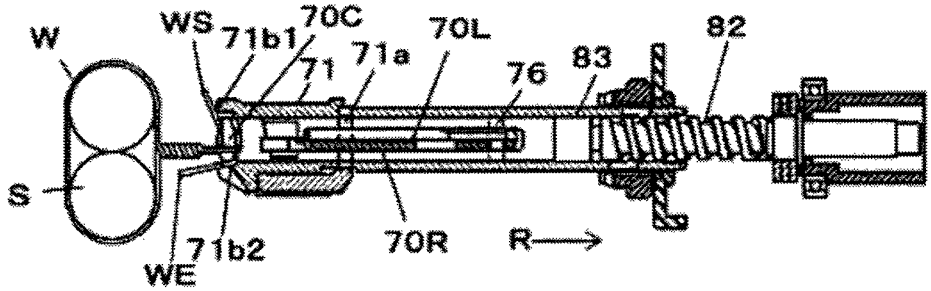

Thereby, the motor 80 is further driven in the forward rotation direction, so that the gripping part 70 gripping the wire W is rotated integrally with the bending part 71 and twists the wire W, as shown in FIG. 10D.

After twisting the wire W, the motor 80 is driven in the reverse rotation direction, so that the motor 80 moves the moveable member 83 in a backward direction denoted with an arrow R. That is, the rotating operation of the moveable member 83 coupled to the rotation of the motor 80 is regulated by the rotation regulation member 84, so that the rotation of the motor 80 is converted into the linear movement.

Thereby, the moveable member 83 is moved backward. As the moveable member 83 is moved backward, the first moveable gripping member 70L and the second moveable gripping member 70R are displaced in the directions of separating from the fixed gripping member 70C, so that the gripping part 70 releases the wires W. In the meantime, when the binding operation for the reinforcing bars S is completed, it is preferable to push the power supply switch 92 to be at the off state.

<Example of Operational Effects of Reinforcing Bar Binding Machine of Embodiment>

For example, when binding the reinforcing bars S forming a base by the wire W, an operation using the reinforcing bar binding machine 1A is performed at a state where the reinforcing bar binding machine 1A is made to face downward so that an opening between the first guide 50 and the second guide 51 of the curl guide unit 5A faces the reinforcing bars S.

According to the related-art binding machine, at a state where the operator grips the handle part 11A and makes the curl guide unit 5A face the reinforcing bars S so as to bind the reinforcing bars S with the wire W, it is difficult for the operator to visually recognize the setting unit 9A. For this reason, when the operator wants to check the setting unit 9A for checking whether the power supply is on, whether an error has occurred, which step the torsional torque is set to, or the like, it is necessary to lift the reinforcing bar binding machine 1A from the state where it faces the reinforcing bars S to a position at which the setting unit 9A is seen, or to change a posture of the operator to a posture at which the setting unit 9A of the reinforcing bar binding machine 1A can be seen.

In contrast, in the embodiment, since the setting unit 9A is provided on the rear surface 10*b* opposite to the curl guide unit 5A of the main body part 10A, it is possible to visually recognize the setting unit 9A at the state where the curl guide unit 5A faces the reinforcing bars S. For this reason, the operator can easily check and operate the setting unit 9A while performing the binding operation. Even in a state where the operator tilts the curl guide unit 5A in a direction of facing the reinforcing bars S with gripping the handle part 11A, the operator can operate the setting unit 9A while seeing the same. When the setting unit 9A includes the adjustment dial 91 of the torsional torque, the operator can check a set state of the torsional torque and adjust the adjustment dial 91 even in the state where the curl guide unit 5A is tilted in the direction of facing the reinforcing bars S. When the setting unit 9A includes the power supply switch 92, the operator can check whether the power supply switch 92 is at the on or off state and then operate the power supply switch 92 even in the state where the curl guide unit 5A is tilted in the direction of facing the reinforcing bars S. When the setting unit 9A includes the lamp 93, the operator can check the on or off state of the power supply and the notification of an operation error made by the lamp 93 even in the state where the curl guide unit 5A is tilted in the direction of facing the reinforcing bars S. In the meantime, the setting unit 9A may be provided at a side surface of the main body part 10A as long as the setting unit 9A is provided on the opposite end side (rear side) of the main body part 10A and can be seen at the state where the curl guide unit 5A faces the reinforcing bars S.

In the meantime, the setting unit 9A is not limited to being provided on the rear surface 10*b* of the main body part 10A as long as the setting unit 9A is provided at a rear side of the housing of the reinforcing bar binding machine 1A. For example, the setting unit 9A may be provided at a rear side of the battery mounting part 11*b*. Likewise, the concave part 10*c* and the convex part 10*d* are not limited to being provided on the surface 10*b* of the main body part 10A as long as the concave part 10*c* and the convex part 10*d* are provided at a rear side of the housing of the reinforcing bar binding machine 1A. For example, the concave part 10*c* and the convex part 10*d* may be provided at the rear surface of the battery mounting part 11*b*.

Also, since the operator can operate the setting unit 9A with gripping the handle part 11A and tilting the curl guide unit 5A in the direction of facing the reinforcing bars S, the operator can perform the operation of binding the reinforcing bars S with the wire W by operating the trigger 12A and the operation of operating the setting unit 9A at a state where the reinforcing bar binding machine 1A is made to face in the same direction. For this reason, it is not necessary to move the reinforcing bar binding machine 1A between the operation of operating the trigger 12A and the operation of operating the setting unit 9A, and it is possible to shorten the time necessary to move the reinforcing bar binding machine 1A, so that the operation efficiency is improved.

As shown in FIG. 9, the setting unit 9A is provided in the concave part 10*c* of the rear surface 10*b* of the main body part 10A and the convex part 10*d* protrudes more from the rear surface 10*b* than the setting unit 9A. Therefore, even when the reinforcing bar binding machine 1A is put at the operation place G by locating the rear surface 10*b* of the main body part 10A to a bottom, the setting unit 9A is not contacted to the operation place G and the convex part 10*d* is contacted to the operation place G. For this reason, even when the reinforcing bar binding machine 1A is put at the operation place G or the like by locating the rear surface 10*b* to a bottom, a situation where the setting unit 9A is pressed by the operation place G and an operation content of the setting unit 9A is changed does not occur. Specifically, even when the reinforcing bar binding machine 1A is put at the operation place G or the like by locating the rear surface 10*b* to a bottom, a situation where the power supply switch 92 is erroneously pushed or the adjustment dial 91 is contacted to the operation place G and the setting thereof is changed does not occur. In the meantime, the convex part 10*d* of the embodiment is provided to surround the concave part 10*c* and the setting unit 9A but not limited thereto. For example, the concave part 10*c* may be omitted, and the convex part 10*d* may be provided not to surround the setting unit 9A and the concave part 10*c* and may be instead provided to surround the setting unit 9A or the concave part 10*c*. Also, the convex part 10*d* may be omitted and the setting unit 9A may be provided in the concave part 10*c*.

Also, the concave part 10*c* is configured to form the series of paths 10*f* facing toward the notch 10*e* by using the setting unit 9A and the convex part 10*d* as walls. Therefore, upon an operation on rainy days, even when water enters into the concave part 10*c*, the water introduced into the concave part 10*c* can flow from the paths 10*f* toward the notch 10*e*, and can flow outside the concave part 10*c* from the notch 10*e*. For this reason, the water does not remain in the concave part 10*c*. In the meantime, the notch 10*e* provided to the convex part 10*d* is not limited to one place, and a plurality of notches 10*e* may be provided. Also, the present disclosure is not limited to the notch 10*e* as long as the water introduced into the concave part 10*c* can flow outside the concave part 10*c* from the paths 10*f*. For example, the convex part 10*d* may be formed at a side with a hole portion configured to communicate with the surface 10*b* of the main body part 10A. Also, a configuration is possible in which the concave part 10*c* is formed at a side with a notch or a hole portion configured to communicate with the surface 10*b* of the main body part 10A and the water introduced into the concave part 10*c* flows out of the notch or the hole portion.

In the embodiment, as the setting unit 9A, the adjustment dial 91, the power supply switch 92 and the lamp 93 are provided. However, at least one is preferably provided on the surface 10*b* of the main body part 10A. Also, the adjustment made by the adjustment dial 91 is not limited to the six steps. The rotation speed of the motor 80 may be made constant without the adjustment dial 91. Alternatively, an adjustment dial capable of making an adjustment in two or more steps or an adjustment dial capable of adjusting the number of turns of the wires W may also be provided.

1A . . . reinforcing bar binding machine, 2A . . . magazine, 20 . . . reel, 3A . . . wire feeding unit, 5A . . . curl guide unit, 6A . . . cutting unit, 7A . . . binding unit, 8A . . . drive unit, 9A . . . setting unit, 12A . . . trigger, 30L . . . first feeding gear, 30R . . . second feeding gear, 31L . . . tooth part, 32L . . . groove portion, 31R . . . tooth part, 32R . . . groove portion, 33 . . . feeding motor, 34 . . . drive force transmission mechanism, 50 . . . first guide (curl guide), 51 . . . second guide (inductive guide), 52 . . . guide groove, 53 . . . retraction mechanism, 53*a*, 53*b* . . . guide pin, 54 . . . third guide part, 54*a* . . . wall surface, 55 . . . fourth guide part, 55*a* . . . wall surface, 55*b* . . . shaft, 60 . . . fixed blade part, 61 . . . moveable blade part, 62 . . . transmission mechanism, 70 . . . gripping part, 70C . . . fixed gripping member, 70L . . . first moveable gripping member, 70R . . . second moveable gripping member, 71 . . . bending part, 71*a* . . . opening and closing pin, 76 . . . shaft, 77 . . . opening and closing guide hole, 78 . . . opening and closing portion, 80 . . . motor, 81 . . . decelerator, 82 . . . rotary shaft (twisting shaft), 83 . . . moveable member, 91 . . . adjustment dial, 92 . . . power supply switch, 93 . . . lamp (information notification unit), S . . . reinforcing bars (the object to be bound), W . . . wire

The invention claimed is:

1. A binding machine comprising:

a wire feeding unit configured to feed a wire;

a curl guide configured to curl the wire fed by the wire feeding unit around an object to be bound;

a binding unit including a twisting shaft provided to be rotatable around a predetermined axis, and a gripping part provided at one end side of the twisting shaft, wherein the gripping part is configured to grip the wire curled by the curl guide and the twisting shaft is configured to twist the gripped wire so as to bind the object;

a binding machine main body having one end side at which the curl guide is arranged and configured to accommodate therein the wire feeding unit and the binding unit; and a setting unit provided at an opposite end side of the binding machine main body and configured to set a predetermined operation condition, wherein the binding machine main body includes a convex part provided around the setting unit, and wherein the convex part includes a notch or a hole portion configured to communicate with a surface of the binding machine main body.

2. A binding machine comprising:

a wire feeding unit which feeds a wire;

a curl guide which curls the wire fed by the wire feeding unit around an object to be bound;

a binding unit including a twisting shaft which is rotatable around a predetermined axis, and a gripping part located at one end of the twisting shaft, wherein the gripping part grips the wire curled by the curl guide and the twisting shaft twists the gripped wire so as to bind the object;

a motor which operates the binding unit;

a binding machine main body having a front end side at which the object is bound, a rear end side at an opposite end to the front end side, and a top side which extends between the front end side and the rear end side, wherein a handle part extends downwardly from the binding machine main body at a lower portion of the binding machine main body, wherein the rear end side extends downwardly from the top side at a rear of the binding machine main body, wherein the curl guide is located at the front end side, and wherein the wire feeding unit, the motor and the binding unit are housed by the binding machine main body;

a setting unit located at the rear end side of the binding machine main body and which sets a predetermined operation condition, wherein the setting unit includes a manually operable adjustment device which adjusts operation of the motor.

3. The binding machine according to claim 2, wherein the manually operable adjustment device includes a dial located on the binding machine main body at the rear end side, wherein the dial is rotatable to plural positions corresponding to plural motor operating conditions.

4. The binding machine according to claim 3, further including a power switch to switch the binding machine between ON and OFF;

wherein the plural positions of the dial correspond to plural different operating conditions of the motor when the binding machine is ON; and wherein the plural different operating conditions of the motor correspond to at least one of different speeds or different torques of the motor.

5. The binding machine according to claim 4, wherein the power switch is located at the rear end side of the main body.

6. The binding machine according to claim 5, wherein the plural positions of the dial are visually recognizable at the rear end side in a state in which a user holds the handle part with the curl guide facing an object being bound and the rear end side facing the user.

7. The binding machine according to claim 2, wherein the handle part extends from the binding machine main body in a direction intersecting with the predetermined axis.

8. The binding machine according to claim 2, wherein the binding machine main body includes a protruding portion protruding at the rear end side of the main body at a location adjacent to the setting unit.

9. The binding machine according to claim 8, wherein the protruding portion of the binding machine main body includes a convex part provided around at least a portion of the setting unit.

10. The binding machine according to claim 9, wherein the convex part surrounds at least a portion of the setting unit.

11. The binding machine according to claim 2, wherein the binding machine main body includes a concave part located on a surface of the rear end side, and at least a portion of the setting unit is located in the concave part.

12. The binding machine according to claim 11, wherein the binding machine main body further includes a convex part provided around the concave part.

13. The binding machine according to claim 11, wherein the concave part includes a notch or an open portion to communicate with a surface of the binding machine main body.

14. The binding machine according to claim 11, wherein the setting unit includes a power supply switch of the binding machine, and a dial which adjusts a rotation speed of the motor or torque of the motor, and wherein at least the dial is provided in the concave part.

15. The binding machine according to claim 2, wherein the setting unit includes a power supply switch, and the setting unit further includes a notification unit configured to emit light so as to notify whether the power supply switch is at an ON state or an OFF state.

16. The binding machine according to claim 2, wherein the binding machine main body includes at least one protrusion protruding at the rear end side of the binding machine main body and protruding in a direction away from the front end side, and wherein when viewed in a direction looking toward the rear end side, the at least one protrusion is provided along at least one side of the setting unit and another side of the setting unit is open.

17. The binding machine according to claim 16, wherein with respect to the direction away from the front end side, a rearwardmost part of the at least one protrusion protrudes farther reward than a rearwardmost part of the setting unit.

18. The binding machine according to claim 2, wherein the binding machine main body includes at least one protrusion protruding at the rear end side of the binding machine main body and protruding in a direction away from the front end side, and wherein with respect to the direction away from the front end side the at least one protrusion extends along at least part of a thickness of the setting unit.

19. The binding machine according to claim 18, wherein with respect to the direction away from the front end side, a rearwardmost part of the at least one protrusion protrudes farther reward than a rearwardmost part of the setting unit.

* * * * *